United States Patent [19]

Wittmann

[11] Patent Number: 4,662,648

[45] Date of Patent: May 5, 1987

[54] HEEL HOLDER

[75] Inventor: Heinz Wittmann, Vienna, Austria

[73] Assignee: TMC Corporation, Baar, Switzerland

[21] Appl. No.: 683,604

[22] Filed: Dec. 19, 1984

[30] Foreign Application Priority Data

Dec. 19, 1983 [AT] Austria ..... 4419/83

[51] Int. Cl.[4] ..... A63C 9/08

[52] U.S. Cl. ..... 280/614; 280/626; 280/634

[58] Field of Search ..... 280/614, 618, 620, 626, 280/631, 632, 633, 634

[56] References Cited

U.S. PATENT DOCUMENTS

| | | | |
|---|---|---|---|
| 3,608,918 | 9/1971 | Heckl et al. | 280/626 |
| 3,773,341 | 11/1973 | Mimeur | 280/632 |
| 4,111,453 | 9/1978 | Krob | 280/626 |
| 4,428,597 | 1/1984 | Wittman | 280/626 |

*Primary Examiner*—John J. Love
*Assistant Examiner*—Richard Camby
*Attorney, Agent, or Firm*—Flynn, Thiel, Boutell & Tanis

[57] ABSTRACT

The invention relates to a heel holder for a safety ski binding, in particular for a safety ski binding for use in both cross-country skiing and downhill skiing. The heel holder has a bearing block fixedly oriented relative to the ski and a housing which carries a sole holder. The housing is supported for an upward pivoting movement about a transversely extending axis provided on the bearing block and against the force of a spring. A spring is arranged in a chamber provided on the housing. One end of the spring is supported on a housing-fixed part and the other end is supported on an adjustable abutment pivotally supported on the bearing block. A two-arm release lever is hingedly connected to the bearing block. A control bolt exists on the housing and is guided along a control cam surface arranged on the two upstanding sidewalls of the bearing block.

5 Claims, 7 Drawing Figures

HEEL HOLDER

FIELD OF THE INVENTION

This invention relates to a heel binding structure convertible between a cross-country and a downhill mode of skiing and having structure for facilitating a release of the ski boot from the binding.

BACKGROUND OF THE INVENTION

Austrian Patent No. 369 660 (corresponds to U.S. Pat. No. 4,428,597) describes a heel holder for a safety ski binding, in particular a safety ski binding convertible between a cross-country and a downhill mode of skiing. The heel holder has a bearing block which can be fixed relative to the ski and a housing which has a down-holding means and which can be swung up against the force of a spring. The spring is arranged in a spring chamber provided in the housing and has one end supported on a housing-fixed part and the other end on an adjustable abutment supported on the bearing block. The abutment is pivotal about an axis which is arranged on the bearing block. The axis—viewed in longitudinal direction of the ski—is offset upwardly and to the rear with respect to the control bolt. A control bolt is mounted on the housing and is guided along a cam surface arranged on each of the two sidewalls of the bearing block. Further, each cam is defined by the inner edge of a kidney-shaped or arcuate recess located in each sidewall of the bearing block. The two end regions of both recesses, figuratively speaking, "point" in a direction toward the ski shoe.

This heel holder has proved to be very successful due to its realiable designa and experiences great popularity. However, in the case of a voluntary release of the heel holder, the release lever always had to be pivoted and necessitated a compressing of the spring stored in the spring chamber. The ability of the ski shoe to leave the heel holder in emergency situations without effecting a pivoting of the release lever did not exist in the known construction.

The goal of the invention is to overcome this disadvantage and to provide an improvement to the known heel holder such that the possibility of an emergency exiting from the binding is possible and without necessitating an operation of a release lever.

This goal is inventively achieved primarily by the projecting ends of an axle being supported in slide rings guided in arcuate grooves, the center points of which, in the skiing position of the heel holder, coincide with the axis of the control bolt, are guided on the inner sides of the sidewalls of the bearing block and can be locked in their uppermost position. When the two slide rings are unlocked, they can slide downwardly and the ski shoe can leave the heel holder.

Various possibilities exist for the structural features of the lock for the two slide rings. Thus, according to a first embodiment of the locking device for the slide rings in the upper position, a U-shaped bar is provided, the legs of which are guided in grooves arranged on the inner sides of the sidewalls, extend radially with respect to the control bolt and intersect the circular grooves for the slide rings. It is preferable for the bar to be under the influence of at least one spring which urges it to move into the locking position.

Another inventive embodiment is distinguished by swingably supporting a U-shaped lever on the inner sides of the sidewalls of the bearing block, the lever arms thereof having projections on its free ends, which projections, in the skiing position, secure the two slide rings against movement in the grooves. In this design it is preferable for the lever to be under the influence of at least one spring urging it into a position wherein its projections project into the grooves and path of movement for the slide rings.

BRIEF DESCRIPTION OF THE DRAWINGS

Two exemplary embodiments of the subject matter of the invention are illustrated in the drawings, in which.

DETAILED DESCRIPTION

Figure 1:
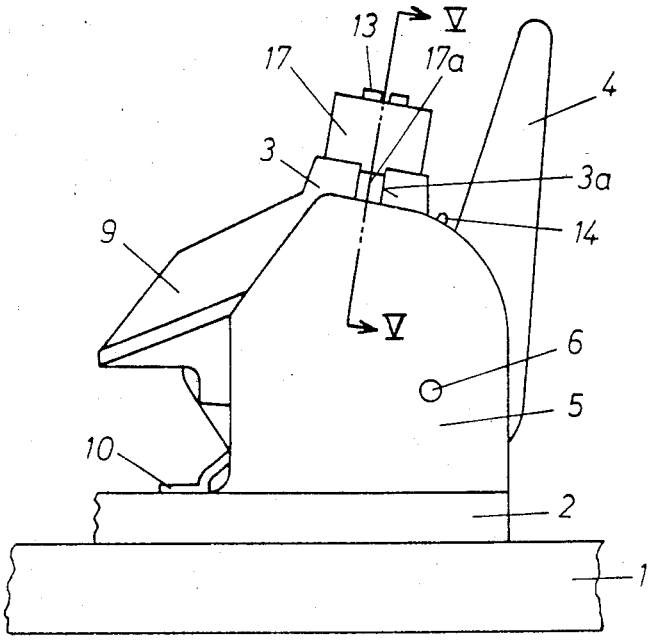
FIG. 1 is a side view of an inventive heel holder according to a first embodiment in the skiing position.

The invention disclosed herein is an improvement over the invention disclosed and claimed in U.S. Pat. No. 4,428,597 and reference thereto is to be incorporated herein.

A safety ski binding which is designated for cross-country skiing use is arranged on a ski. The binding has a not illustrated front jaw and a cross-country skiing plate 2 which is hingedly connected to the front jaw. The plate 2 has a heel holder mounted adjacent the rear end thereof. The heel holder or the cross-country skiing plate 2 is fixable on the ski by means of a locking mechanism which is not illustrated.

A bearing block 5 which is secured to the cross-country skiing plate 2 consists substantially of two laterally spaced sidewalls, between which is arranged a housing 3. The housing 3 has a down-holding means 9 and has a pivotally supported stepping mandrel 10 thereon. A control bolt 7 is arranged perpendicularly with respect to the longitudinal axis of the cross-country skiing plate 2 and extends laterally through the housing 3. The control bolt 7 is guided on the inner edges of a kidney-shaped or arcuate recess 8 provided in each of the sidewalls of the bearing block 5, which edges each define a cam surface 8*a*.

Figure 2:
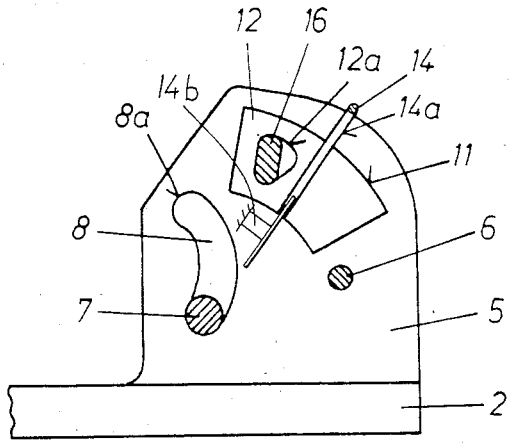
FIGS. 2 and 3 are views of the sidewall of the bearing block in the skiing position and in the released position, respectively.
Figure 2A:
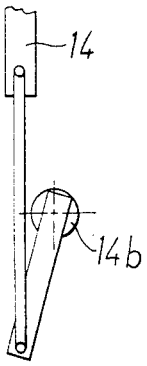
FIGS. 2A and 3A show further details of the torsion spring corresponding, respectively, to the position of the bar illustrated in FIGS. 2 and 3.
Figure 3:
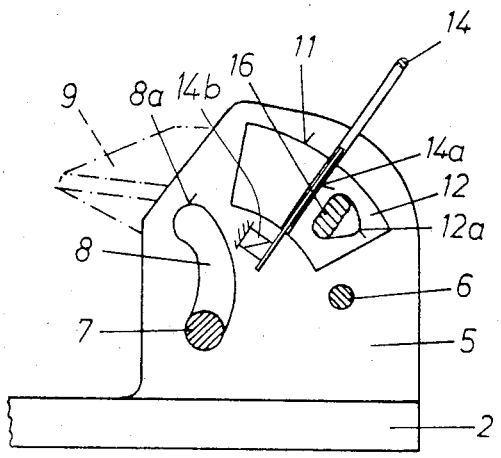
Figure 3A:
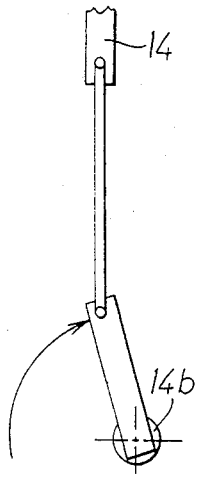
Figure 4:
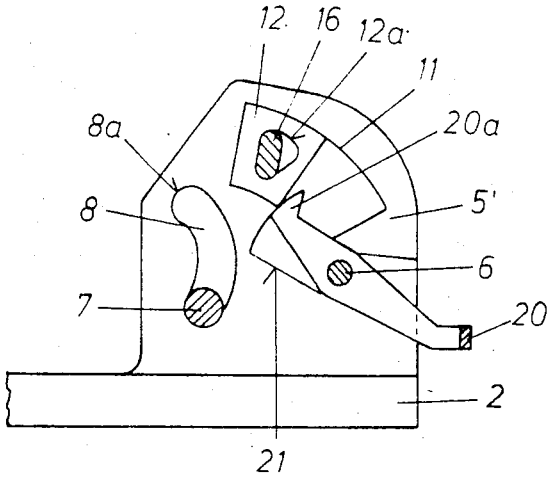
FIG. 4 illustrates a view of the sidewall of a modified embodiment of the bearing block in the skiing position.

The housing 3, which is manufactured preferably of plastic, has an elongate and cylindrical spring chamber therein which extends approximately vertically when the heel holder is in the skiing position. The chamber opens upwardly and outwardly of the housing 3. A sleeve 17 which is open at one end is oriented so that the open end is received in the open end of the spring chamber and is movably guided therein by means of two laterally outwardly projecting protuberances 17*a* on the sleeve 17 each being received in guide slots 3*a* provided on the housing 3. The sleeve 17 also has a pair of laterally projecting and coaxial axle pieces 16 supported in a pair of substantially circular-sector-shaped recesses 12*a* in slide rings 12. The axle pieces 16 are elongate having—viewed in cross section—a generally rectangular shape with rounded end walls as shown in FIGS. 2 to 4. The slide rings 12 are movably guided in grooves 11 provided on the inner surfaces of the sidewalls of the bearing block 5. An adjusting screw 13 extends through the closed end of the sleeve 17 and serves to facilitate an adjustment of the initial tension of the spring which is provided inside the spring chamber.

Between the sidewalls of the bearing block 5 there is arranged a release lever 4 pivotally hinged by means of an axle 6 on the bearing block 5. The release lever 4 has two lever arms thereon. The lever arm which projects beyond the confines of the bearing block 5 is engagable by the hand of the user.

Figure 5:
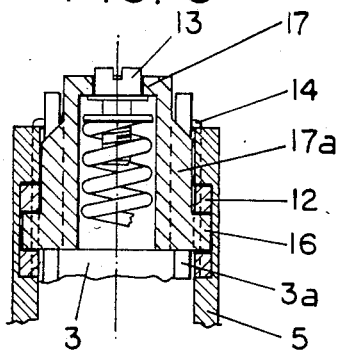
FIG. 5 is a sectional view taken along the line V—V of FIG. 1.

In the case of an automatic release operation, the control bolt 7 is guided along the cam surface 8*a*. The down-holder means 9 together with the housing 3 are simultaneously swung and moved upwardly. Since the sleeve 17 and the sprng abutment thereon are held on the bearing block 5 by the axle pieces 16, the housing 3 is able to slide upwardly by means of the guide slots 3*a* provided thereon along the protuberances 17*a* on the sleeve 17. Further, the spring (see FIG. 5) which is in the spring chamber becomes compressed. At the same time there occurs a pivotal movement of the housing 3 about the axle pieces 16 which hold the sleeve 17 on the bearing block 5. When the control bolt,7 has exceeded the release point of the cam surface 8*a*, then the heel holder swings into its open position, and the ski shoe which is in the binding is released. The release lever 4 remains, during an automatic release operation, in its initial position. During a stepping into the binding with the ski shoe, the down-holding means 9 is moved from the ski shoe releasing position into the skiing position overcoming the stepping-in force.

A voluntary opening of the heel holder occurs by swinging the release lever 4 clockwise (FIG. 1), and the spring (not illustrated) which is provided in the spring chamber is compressed.

If the distance of the axle pieces 16 from the control bolt 7 is reduced, then during an opening of the heel holder the angle of traverse of the down-holding means 9 is enlarged. The swivel axis for this movement of the down-holding means is formed by the two lower rounded regions of the axle pieces 16. Of course, the three corner regions of the recesses 12*a* in the slide rings 12 are rounded off with a radius corresponding to the rounded regions on the axle pieces 16.

In the skiing position of the heel holder, the axle pieces 16 rest on the straight sides of the recesses 12*a* adjacent the down-holding means 9.

During an opening of the heel holder, be it voluntary or automatic, the axle pieces 16 swing, as soon as the control bolt 7 has exceeded the release points of the cam surface 8*a*, about the axis of their lower rounded region, until they come to rest on the straight sides of the recesses 12*a* remote from the down-holding means 9.

In the skiing position of the heel holder, the two slide rings 12 are secured in place by a U-shaped bar 14 and prevented from moving in the grooves 11. The two legs of the U-shaped bar 14 are received in grooves 14*a* recessed in the inner sides of the sidewalls of the bearing block 5 and intersect the grooves 11 for the slide rings 12 at a right angle (see FIG. 2).

If an emergency exiting of the ski shoe is to occur, then the U-shaped bar 14 is pulled upwardly until it unblocks the grooves 11 for the two slide rings 12. The slide rings 12 can thereafter move unhindered in the grooves 11 toward the upper side of the ski to effect a release of the ski shoe (see FIG. 3). The control bolt 7 remains at the lower end of the recesses 8. Also nothing is changed in regard to the initial tension of the spring which is provided in the spring housing during the movement of the two slide rings 12. Therefore, during a return of the two slide rings 12 into the skiing position of the heel holder (i.e. FIG. 2 position) only the friction of the slide rings 12 in the grooves 11 must be overcome.

In order to prevent an involuntary movement of the bar 14, there exists the possibility of providing at least one torsion spring 14*b* to urge the bar into the grooves 14*a*. The torsion spring could be arranged in one of the sidewalls of the bearing block 5 and preferably urge the bar toward the control bolt 7.

FIG. 4 illustrated a modified exemplary embodiment of the invention. A U-shaped two-arm lever 20 is utilized for locking the two slide rings 12 in the skiing position. Each of the legs of the lever 20 are received in recesses 21 on the inner sides of the sidewalls of the bearing block 5' and have projections 20*a* thereon. These two legs effect a holding of the two slide rings 12 in the skiing position. The lever 20 is pivotally supported on the same axis 6 as is the release lever 4. If the end of the lever 20 remote from the projections 20*a* and projecting from the bearing block 5' is lifted, then the two projections 20*a* are moved out of the grooves 11 and out of the path of the slide rings 12 to thereby enable the ski shoe to leave the heel holder. Of course the lever 20 is also under the influence of at least one spring urging to swing the projections into the path of movement of slide rings 12.

Of course the invention is not to be limited to the exemplary embodiments which are illustrated in the drawings and which are described above. Rather various modifications thereof are possible without departing from the scope of the invention. For example, embodiments wherein the projections on the two-arm lever are received, in the skiing position of the heel holder in recesses provided in the slide rings also fall under the scope of the invention.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heel holder for a safety ski binding, for use in cross-country skiing and downhill skiing, said heel holder having a bearing block which is adapted to be fixed relative to a ski and a housing which has a down-holding means thereon, means for supporting said housing for upward pivotal movement against the force of a spring arranged in a spring chamber provided in said housing, one end of said spring being supported on a housing-fixed part and its other end on a sleeve-like adjustable abutment supported on said bearing block, said heel holder further having a control bolt which is supported on said housing for guided movement along a cam surface arranged on the two sidewalls of said bearing block, said abutment being pivotal about an axis arranged on said bearing block and upwardly offset rearwardly with respect to an axis of said control bolt, each said cam surface being defined by the inner edge of an arcuate recess in the sidewalls of said bearing block, the two end regions of each recess pointing in a direction toward a ski shoe, the improvement comprising wherein said axis arranged on said bearing block includes a pair of coaxial axle pieces projecting into recesses provided in slide rings movably guided in arcuate grooves on inner sides of said sidewalls of said bearing block between upper and lower positions, wherein centerpoints of the arc in said arcuate grooves, in the skiing position of said heel holder, coincide with said axis of said control bolt, and wherein means are provided for locking said slide rings in said upper position.

2. The heel holder according to claim 1, wherein said means for locking said slide rings in said upper position includes a U-shaped bar, the legs of which are guided in further grooves arranged on said inner sides of said sidewalls, extend radially with respect to said control bolt and intersect said arcuate grooves for said slide rings.

3. The heel holder according to claim 2, wherein said bar is under the influence of at least one spring urging it to move into the locking position.

4. The heel holder according to claim 1, wherein a lever is pivotally supported on said inner sides of said sidewalls of said bearing block, said lever having a U-shaped construction with a manually engageable end at one end and projection means, at its other end, said projection means, in the skiing position, effecting a securing of said two slide rings against movement in said arcuate grooves.

5. The heel holder according to claim 4, wherein said lever is under the influence of at least one spring, which urges it into a position in which said projection means projects into said arcuate grooves and path of movement for said slide rings.

* * * * *